US006629338B2

(12) United States Patent
Dierolf et al.

(10) Patent No.: US 6,629,338 B2
(45) Date of Patent: Oct. 7, 2003

(54) HANDLE FOR A TOOL

(75) Inventors: Andreas Dierolf, Untermünkheim (DE); Karl Lieser, Wuppertal (DE)

(73) Assignee: Adolf Wuerth GmbH & Co. KG, Kuenzelsau (DE)

( * ) Notice: Subject to any disclaimer, the term of this patent is extended or adjusted under 35 U.S.C. 154(b) by 0 days.

(21) Appl. No.: 09/936,740

(22) PCT Filed: Jan. 18, 2001

(86) PCT No.: PCT/EP01/00521

§ 371 (c)(1),
(2), (4) Date: Sep. 12, 2001

(87) PCT Pub. No.: WO01/53046

PCT Pub. Date: Jul. 26, 2001

(65) Prior Publication Data

US 2002/0133911 A1 Sep. 26, 2002

(30) Foreign Application Priority Data

Jan. 19, 2000 (DE) ..... 100 01 885

(51) Int. Cl.[7] ..... A45C 13/22

(52) U.S. Cl. ..... 16/430; 16/114 R; 16/436; 81/177.1; 81/489; 81/462

(58) Field of Search ..... 16/430, 114 R, 16/421, 436; D8/83; 30/340, 348, 462; 81/427.5, 177.1, 489, 492

(56) References Cited

U.S. PATENT DOCUMENTS 190,459 A * 5/1877 Wilkinson
3,093,172 A * 6/1963 Reed
D256,546 S * 8/1980 Holland-Letz ..... D8/83
4,629,191 A * 12/1986 Mancuso ..... 473/203
4,739,536 A * 4/1988 Bandera et al. ..... 16/430
D346,943 S * 5/1994 Haberstroh ..... D8/83
D375,669 S * 11/1996 Shiao ..... D8/83
D386,063 S * 11/1997 Badiali ..... D8/107
D408,252 S * 4/1999 Holland-Letz ..... D8/107
5,896,620 A * 4/1999 Mink ..... 16/110.1
5,964,009 A * 10/1999 Hoepfl et al. ..... 16/430
D418,035 S * 12/1999 Hatch ..... D8/107
D445,658 S * 7/2001 Dierolf ..... D8/107
D468,183 S * 1/2003 Hu ..... D8/83

FOREIGN PATENT DOCUMENTS

GB 2136726 * 9/1984

* cited by examiner

*Primary Examiner*—Gary Estremsky
*Assistant Examiner*—Mark Williams
(74) *Attorney, Agent, or Firm*—Quarles & Brady LLP

(57) ABSTRACT

The invention proposes a handle for a screwdriver or a similar tool, which over a significant part of its length has a cross-section in the form of an approximately regular pentagon. The corner or angle sections are rounded with a radius of curvature, whose centre is in the longitudinal axis of the tool handle. The corner sections formed by the curved part of the cross-section have a different width over the handle length. The shape of the flattenings does not follow the shape of the handle contour.

10 Claims, 2 Drawing Sheets

HANDLE FOR A TOOL

BACKGROUND OF THE INVENTION

There are numerous different handle shapes for screwdrivers or similar tools. The earliest screwdrivers have a circular cross-section and an approximately convex longitudinal section. Apart from the circular cross-section, cross-sections are known, which are based on a subdivision into two or three. These include cross-sections in the form of a flattened circle and also triangular and hexagonal cross-sections. Polygonal cross-sections have been chosen to improve torque transmission.

A handle for hand tools is already known (DE 9202672), which has a pentagonal cross-section. The edges of the pentagonal cross-section are rounded and the arc length of the rounded part of the cross-section is everywhere substantially the same.

The problem of the invention is to provide an ergonomically improved handle for a screwdriver or similar tool with which it is also possible to transmit a torque. Tools of this type are e.g. screw clamps, where for clamping purposes a screwing movement must also be performed, together with ripping chisels, files, hacksaws,.etc., in which e.g. a twisting must be prevented, which means that a torque must also be applied, namely to prevent twisting.

SUMMARY OF THE INVENTION

To solve this problem the invention proposes a tool handle having a cross-section in the shape of a pentagon over a gripping part of its length, in which an orientation of the pentagon does not change over the length of the handle, and in which the cross-sectional shape has rounded corner sections, which are located on arcs having a center of curvature at the longitudinal axis of the handle, and in which the rounded corner sections of the cross-sectional shape are linked by substantially flat sides.

As a result of the cross-sectional shape in the form of a preferably rounded pentagon over a significant part of the handle length, the handle shape is better adapted to the human hand. Only in end regions gripped by a user for support purposes is there no pentagonal shape.

For reasons of symmetry, the invention prefers the cross-section in the form of an approximately regular pentagon. If symmetry is unnecessary, e.g. in the case of a hacksaw handle, an irregular pentagon can be used.

In a further development of the invention, the cross-sectional shape has rounded angle or corner sections, which are located on an arc with a centre positioned in the longitudinal axis of the handle. Thus, the pentagons are not completely formed and instead their sides are interconnected by rounded sections.

These sides of the approximate pentagonal shape can e.g. be slightly curved, with a much larger radius than the rounded angle sections. However, in particular the sides of the cross-sectional shape can be rectilinear.

In the parts of the tool handle, in which the cross-section is not shaped like an approximate pentagon, the cross-section is preferably circular. This is mainly a question of the rounded dome present at the free end of the handle. The user does not grasp at this point for torque transmission purposes and uses it only for supporting on the ball of the thumb or palm of the hand.

According to a further development of the invention a circular cross-section can also be provided on the opposite part of the tool handle, i.e. at the point where e.g. the screwdriver shank commences.

The shape of the tool handle can be represented by a rotationally symmetrical body with longitudinally directed flattenings.

According to a further development of the invention, the line linking the transition between the arcuate angle sections and the approximately rectilinear sides of the cross-sectional shape does not follow the longitudinal contour of the handle.

This can also be expressed in that the angle over which the arcuate section of the corners extends, is not the same at all points of the handle.

According to a further development of the invention, the tool handle has a first maximum cross-section point having a spacing of approximately 30% of the handle length from the handle dome end.

According to another further development of the invention, the tool handle can have a second maximum cross-section point, which has a spacing of approximately 60 to 70% of the handle length from the handle dome end.

The length of the handle is understood to mean the length available to the user for grasping purposes, i.e. extending from the dome end to a point where the user supports his thumb and optionally index finger.

According to a further development of the invention, the diameter of the tool handle at the first maximum cross-section point is approximately 15 to 18% larger than at the second maximum cross-section point. According to another further development of the invention, the approximately pentagonal shape of the cross-section of the tool handle terminates at the second maximum cross-section point and passes there into a circular cross-sectional shape. It has been found that at this point a circular shape is appropriate, because the ends of the index finger and thumb guide the tool.

According to a further development of the invention, the longitudinal profile of the tool handle from the second maximum cross-section point is concave and preferably up to the handle end associated with the tool. In this area the tool can either be rapidly turned or a finger support can be provided.

According to a further development of the invention, the smallest diameter of the handle is between the second maximum cross-section point and the handle end associated with the tool.

In particular, the maximum handle diameter is approximately 70 to 80% larger than the smallest handle diameter.

BRIEF DESCRIPTION OF THE DRAWINGS

Further features, details and advantages of the invention can be gathered from the following description of a preferred embodiment of the invention, as well as the attached drawings, wherein show:

DETAILED DESCRIPTION

Figure 1:
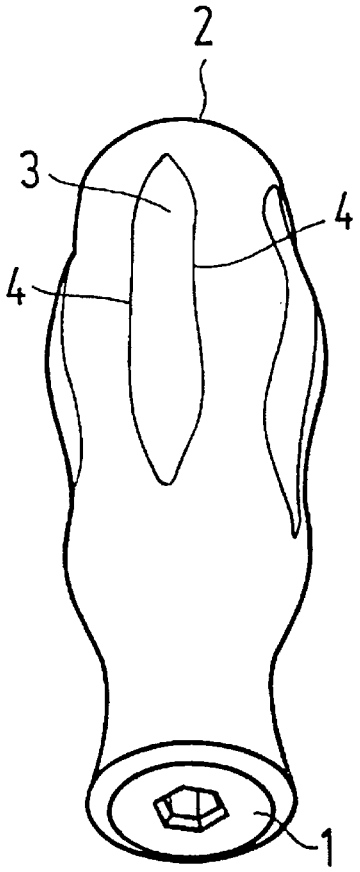

FIG. 1 perspectively shows a tool handle according to the invention, such as can e.g. be used for a screwdriver. The screwdriver shank is not shown. However, the handle can also be used for clamping screw clamps, as well as a handle for hacksaws, ripping chisels or files. In the case of these tools it is a question of either performing a rotary or screwing movement, or of preventing twisting of the tool, which must also be brought about by the application of a torque.

The tool handle extends from an end face 1, from which would pass out the shank of a screwdriver, and along a longitudinal axis to an opposite, free end 2. In the vicinity of the free end 2 the handle is rounded and consequently forms a dome. when using the tool said dome is applied to the palm or ball of the thumb. Between these two ends the tool handle has a maximum cross-section point, which is represented by the plane VI—VI in FIG. 2. The spacing of said plane from the dome end 2 of the tool handle is approximately 30% of the handle length. The term handle length is understood to mean the distance between the free end and the front end face 1. In the vicinity of said end face 1 the handle has a diameter increase on which a user can support his index finger or thumb. It would also be conceivable, starting from this end face 1, to lengthen the handle, without this influencing the use of the handle during turning or screwing. Such an extension should not be calculated in when calculating the handle length.

Figure 2:
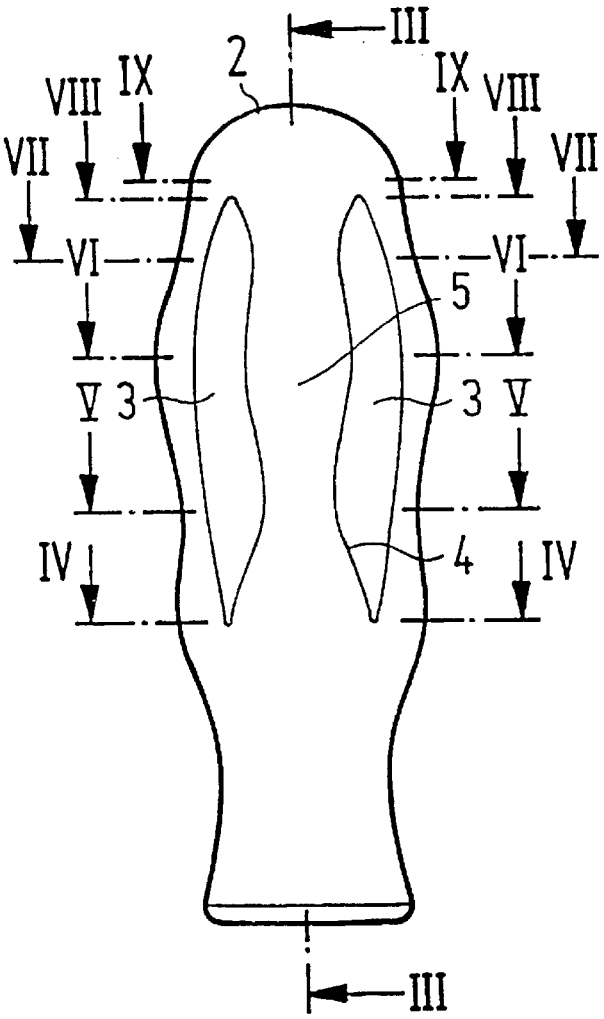

Spaced from the maximum diameter point, the handle has a second maximum cross-section point, represented by plane IV—IV in FIG. 2. Between said two planes there is a point, represented by plane V—V in FIG. 2, where there is a local minimum cross-section.

Starting from the free dome end 2 of the handle, the latter initially has a circular cross-section. At this point no torque has to be transmitted, so that the cross-section is circular for reasons of symmetry.

Starting from the plane VIII, the handle cross-section gradually approaches a pentagon. The "corners" of the pentagon still remain rounded and namely with a radius of curvature, whose centre is located in the longitudinal axis of the handle. The sides of the pentagons are located on straight lines. These straight sides of the pentagonal cross-section, considered over the handle length, form flattenings 3, which are visible in FIG. 2. The points at which the planar sides of the pentagons pass into the remaining curvature of the external shape of the handle, form lines 4. These lines 4 are not parallel to the broken-line centre 5 of the edges and consequently do not follow the longitudinal contour of the handle.

The flattenings 3 end in the vicinity of the second maximum cross-section point, where the handle cross-section again becomes circular. Subsequently there is a reduction in the diameter value in a gradual manner up to the plane C, where the diameter has a minimum. The diameter then increases again. As a result the longitudinal profile between plane IV—IV and the end face 1 becomes concave.

Figure 3:
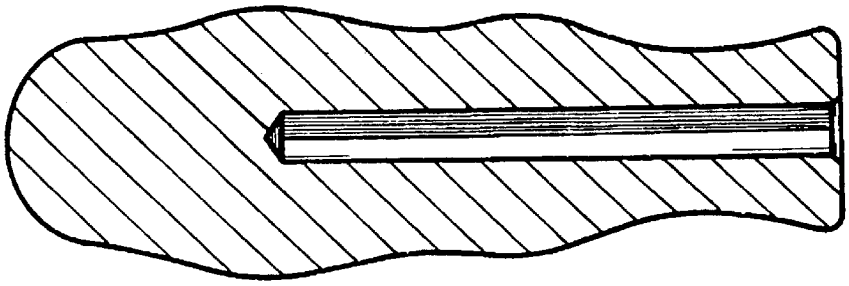

The longitudinal section of FIG. 3 is passed through a plane containing the longitudinal axis of the handle. Comparison of the two outer contours reveals the asymmetry of the right-hand to the left-hand outer contour.

Figure 4:
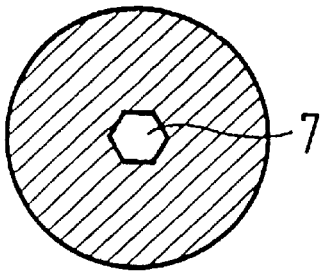
Figure 7:
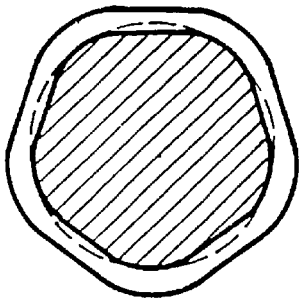
Figure 5:
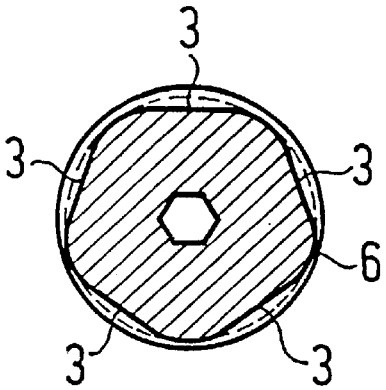

FIGS. 4 to 9 show cross-sections through the handle shape. FIG. 4 corresponds to plane IV—IV in FIG. 2. At this point, in the direction of the tool end of the handle, the zone with the concave outer contour in longitudinal section commences. In the reverse direction the section of the handle where the flattenings 3 are present commences here. This can be gathered from FIG. 5, which is a section through the maximum cross-section point corresponding to plane V—V. It is possible to see that the flattenings 3 form the side of a regular pentagon. These rectilinear sides of the pentagon are interconnected by curved corner sections 6, where the cross-sectional contour is located on a circle, whose centre is in the longitudinal axis 7 of the tool handle.

Figure 6:
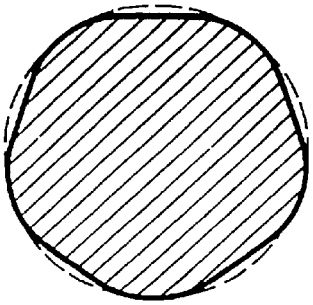
Figure 9:
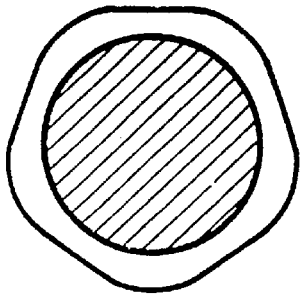

In accordance with FIG. 6, this shape of a pentagon rounded in the corner area continues on to the plane VI—VI, where the largest maximum cross-section point is present. The cross-section then decreases, whilst maintaining the pentagonal shape, in the direction of the plane VII—VII, as an be seen in FIG. 7.

Figure 8:
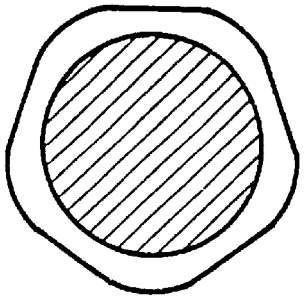

In the following plane VIII—VIII according to FIG. 8, the end of the flattenings 3 is reached, so that there is now once again a circular cross-section and this is maintained up to the free end.

What is claimed is:

1. A tool handle for hand tools, which extends along a longitudinal axis from an end face associated with the tool to a rounded end and which has a cross-section in the shape of a pentagon of constant shape over a gripping part of its length, in which an orientation of the pentagon does not change over the length of the handle;

wherein the cross-sectional shape has rounded corner sections, which are located on arcs having a center of curvature at the longitudinal axis of the handle; and wherein the rounded corner sections of the cross-sectional shape are linked by substantially flat sides.

2. Tool handle according to claim 1, wherein the cross-section is circular in a remainder of the handle length.

3. Tool handle according claim 1, wherein the cross-section is formed by a rotationally symmetrical body with longitudinally directed flattening.

4. Tool handle according to claim 1, wherein a non-straight line provides a transition between the arcuate corner sections and the substantially flat sides of the cross-sectional shape.

5. Tool handle according to claim 1 with a first maximum cross-section point (VI) having a spacing of approximately 30% of the handle length from the rounded handle end.

6. Tool handle according to claim 5, having a second maximum cross-section point (IV), which has a spacing of approximately 60 to 70% of the handle length from the rounded handle end.

7. Tool handle according to claim 6, wherein the handle diameter at the first maximum cross-section point (VI) is approximately 15 to 18% larger than at the second maximum cross-section point (IV).

8. Tool handle according to claim 7, wherein the pentagonal cross-sectional shape ends at the second maximum cross-section point (IV).

9. Tool handle according to claim 6, wherein the longitudinal profile is concave from the second maximum cross-section point (IV) extending up to the handle end associated with the tool.

10. Tool handle according to claim 6, wherein the smallest handle diameter is located between the second maximum cross-section point (IV) and the handle end associated with the tool.

* * * * *